US011077688B2

(12) United States Patent
Iwama et al.

(10) Patent No.: US 11,077,688 B2
(45) Date of Patent: Aug. 3, 2021

(54) LIQUID DISCHARGE HEAD AND LIQUID DISCHARGE APPARATUS

(71) Applicants: Masami Iwama, Ibaraki (JP); Shiomi Andou, Kanagawa (JP); Satoru Yoshida, Ibaraki (JP)

(72) Inventors: Masami Iwama, Ibaraki (JP); Shiomi Andou, Kanagawa (JP); Satoru Yoshida, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/572,079

(22) Filed: Sep. 16, 2019

(65) Prior Publication Data

US 2020/0094595 A1 Mar. 26, 2020

(30) Foreign Application Priority Data

Sep. 20, 2018 (JP) ..... JP2018-175536
Sep. 20, 2018 (JP) ..... JP2018-176061
Feb. 28, 2019 (JP) ..... JP2019-036510

(51) Int. Cl.
*B41J 29/377* (2006.01)
*B41J 2/045* (2006.01)
*B41J 2/14* (2006.01)

(52) U.S. Cl.
CPC ..... *B41J 29/377* (2013.01); *B41J 2/04515* (2013.01); *B41J 2/14233* (2013.01); *B41J 2202/08* (2013.01)

(58) Field of Classification Search
CPC ..... B41J 29/377
See application file for complete search history.

(56) References Cited

U.S. PATENT DOCUMENTS 6,109,802 A 8/2000 Iwama et al.
2004/0263554 A1* 12/2004 Kubo ..... B41J 29/377 347/18
2007/0109364 A1* 5/2007 Ito ..... B41J 2/055 347/71

(Continued)

FOREIGN PATENT DOCUMENTS

JP 2013-063555 4/2013

OTHER PUBLICATIONS

U.S. Appl. No. 16/157,238, filed Oct. 11, 2018, Takakazu Kihira, et al.

*Primary Examiner* — Shelby L Fidler
(74) *Attorney, Agent, or Firm* — Oblon, McClelland, Maier & Neustadt, L.L.P.

(57) ABSTRACT

A liquid discharge head includes a plurality of pressure generating elements configured to generate pressure to discharge a liquid, a plurality of wirings configured to transmit a drive signal to the plurality of pressure generating elements, respectively, a plurality of integrated circuits configured to drive the plurality of pressure generating elements, respectively, the plurality of integrated circuits being provided on the plurality of wirings, respectively, and a heat sink configured to contact the plurality of integrated circuits to dissipate heat in the plurality of integrated circuits. The heat sink includes a first dissipation part that directly contacts one of the plurality of integrated circuits, and a second dissipating part that contacts another of the plurality of integrated circuits via one of the plurality of wirings.

15 Claims, 11 Drawing Sheets

(56) References Cited

U.S. PATENT DOCUMENTS

| | | | | |
|---|---|---|---|---|
| 2007/0229580 | A1* | 10/2007 | Chikamoto | B41J 2/14209 347/29 |
| 2008/0037177 | A1* | 2/2008 | Kobayashi | B41J 29/377 360/264.2 |
| 2010/0328400 | A1 | 12/2010 | Koda et al. | |
| 2013/0068850 | A1 | 3/2013 | Iwama | |
| 2014/0375712 | A1 | 12/2014 | Iwama | |
| 2016/0236469 | A1 | 8/2016 | Iwama | |
| 2017/0253062 | A1 | 9/2017 | Murakami et al. | |
| 2018/0194135 | A1 | 7/2018 | Iwama et al. | |
| 2018/0272709 | A1 | 9/2018 | Iwata et al. | |
| 2019/0263157 | A1* | 8/2019 | Miyazaki | B41J 29/377 |
| 2019/0291487 | A1* | 9/2019 | Tanaka | B41J 29/377 |

* cited by examiner

LIQUID DISCHARGE HEAD AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-175536, filed on Sep. 20, 2018, Japanese Patent Application No. 2018-176061, filed on Sep. 20, 2018, and Japanese Patent Application No. 2019-036510, filed on Feb. 28, 2019, in the Japan Patent Office, the entire disclosure of each of which are hereby incorporated by reference herein.

BACKGROUND

Technical Field

Aspects of the present disclosure relate to a liquid discharge head and a liquid discharge apparatus.

Related Art

Each of Flexible Printed Circuits (FPC) includes an Integrated Circuit (IC) and a heat sink. For example, the heat sink is attached to the IC from a back side of the IC via the FPC to cool the IC.

SUMMARY

In an aspect of this disclosure, a liquid discharge head includes a plurality of pressure generating elements configured to generate pressure to discharge a liquid, a plurality of wirings configured to transmit a drive signal to the plurality of pressure generating elements, respectively, a plurality of integrated circuits configured to drive the plurality of pressure generating elements, respectively, the plurality of integrated circuits being provided on the plurality of wirings, respectively, and a heat sink configured to contact the plurality of integrated circuits to dissipate heat in the plurality of integrated circuits. The heat sink includes a first dissipation part that directly contacts one of the plurality of integrated circuits, and a second dissipating part that contacts another of the plurality of integrated circuits via one of the plurality of wirings, and a thermal resistance of the first dissipation part is different from a thermal resistance of the second dissipation part.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
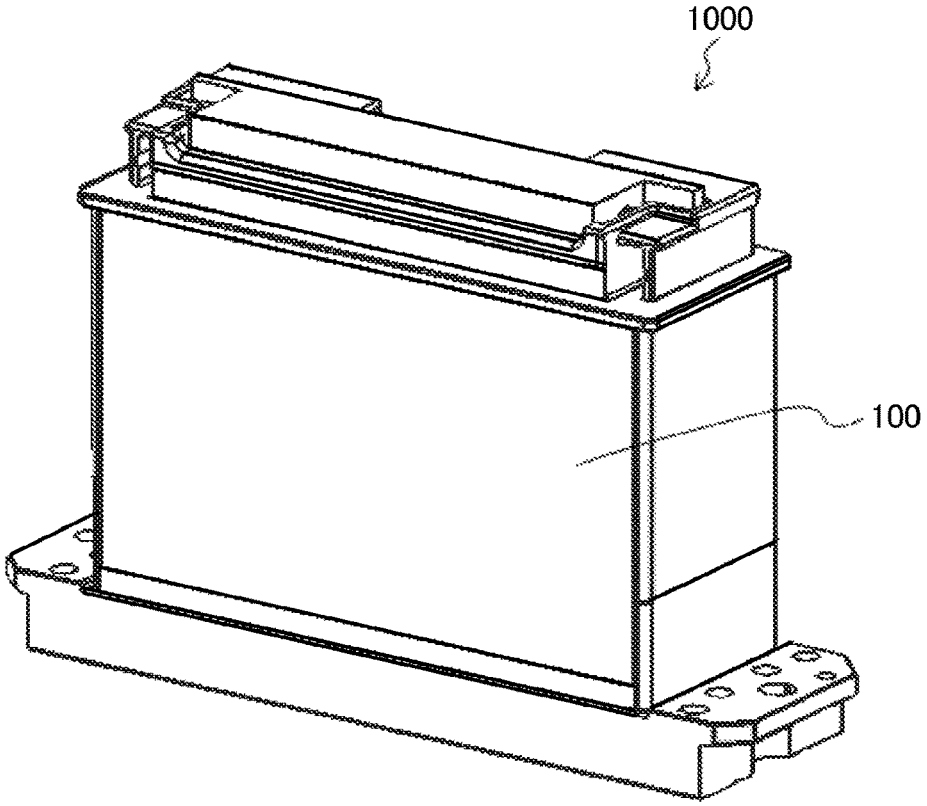
FIG. 1 is an external perspective view of an inkjet head as an example of a liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Descriptions are given in detail below of a liquid discharge head and a liquid discharge apparatus as embodiments according to the present disclosure, with reference to the accompanying drawings.

Figure 2:
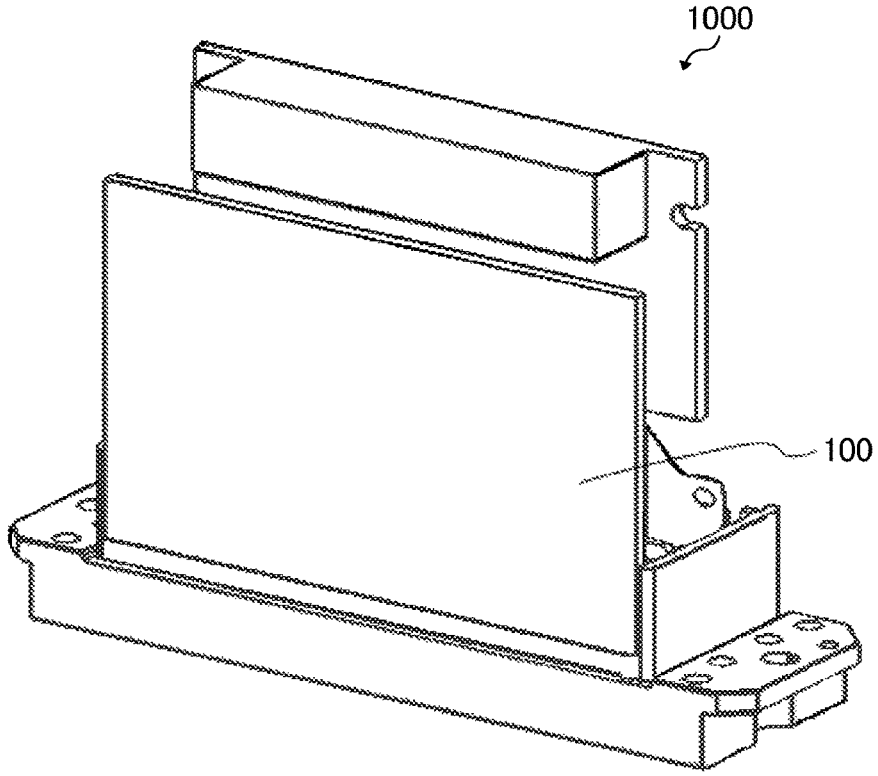
FIG. 2 is an external perspective view of a heat sink in the inkjet head.
Figure 3:
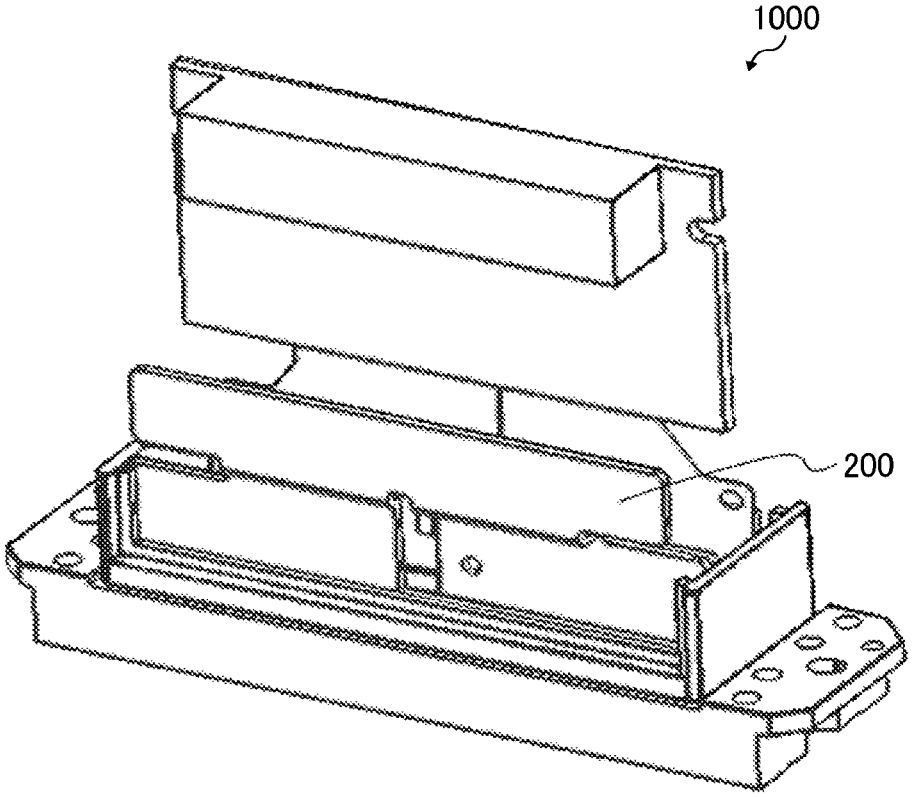
FIG. 3 is an external perspective view of a heat sink in the inkjet head.
Figure 4A:
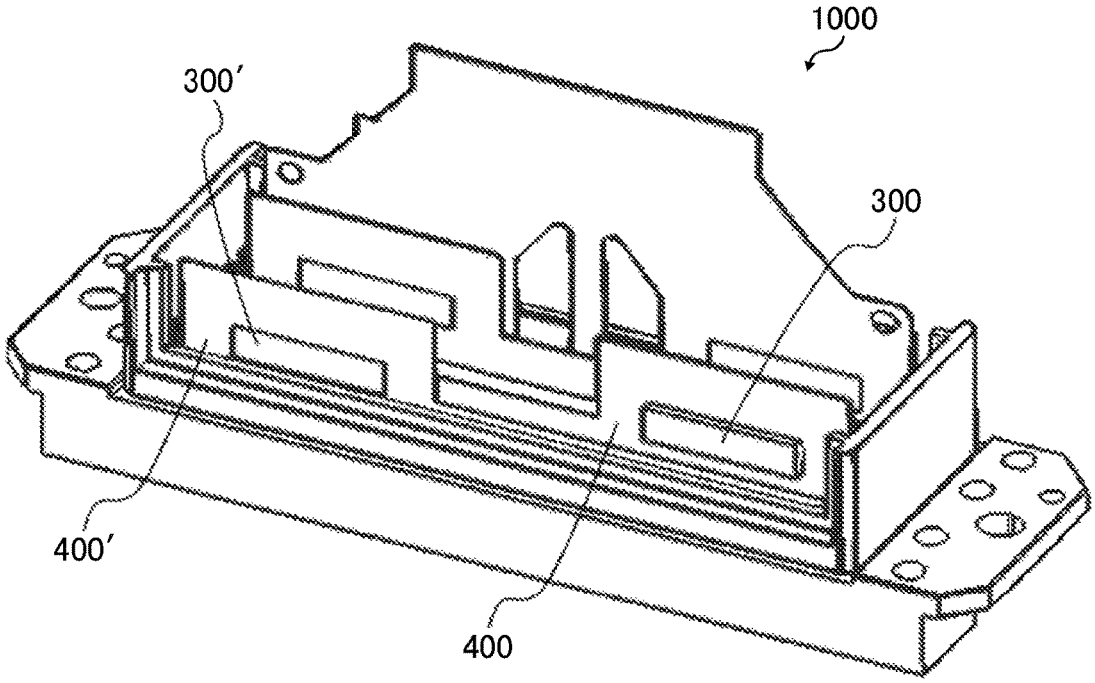
FIG. 4A is an external perspective view of an IC mounted on an FPC.
Figure 4B:
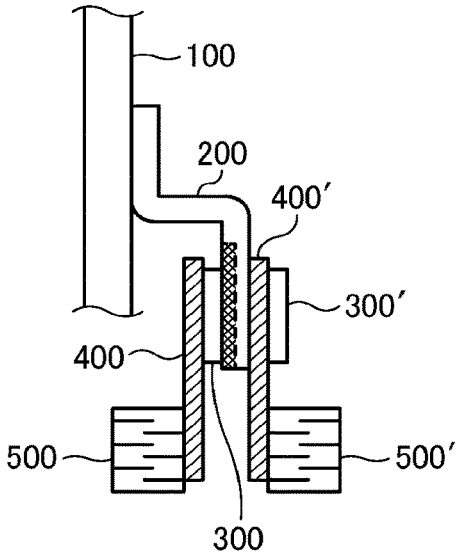
FIG. 4B is an enlarged side view of the IC mounted on the FPC.

FIG. 1 is an external perspective view of an inkjet head 1000 as an example of a liquid discharge head. FIG. 2 is an external perspective view of a heat sink 100 (first heat sink) in the inkjet head 1000. FIG. 3 is an external perspective view of a heat sink 200 (second heat sink) in the inkjet head 1000. FIG. 4 is an external perspective view of an Integrated Circuit (IC) mounted on a Flexible Printed Circuit (FPC).

The inkjet head 1000 includes a heat sink to dissipate (radiate) heat generated from the IC outside the inkjet head 1000. The IC is driven inside the inkjet head 1000. The inkjet head 1000 according to the present embodiment includes a heat sink that is divided into the heat sink 100 illustrated in FIG. 2 and the heat sink 200 illustrated in FIG. 3.

However, the heat sink may include the heat sinks 100 and 200 that form a single unit. The heat sink 100 contacts the air outside the inkjet head 1000. The heat sink 100 dissipates the heat generated from an IC 300 (first IC) and an IC 300' (second IC) outside the inkjet head 1000 via the heat sink 200. The heat sink 200 transfers the heat generated from the IC 300 and the IC 300' to the heat sink 100.

As illustrated in FIG. 4, each of the IC 300 and the IC 300' is mounted on the FPC 400 and the FPC 400' having the same shape. The IC 300 and the IC 300' are disposed to face each other. The IC 300 and the IC 300' are integrated circuits (ICs) that controls to drive a pressure generating elements 500 and 500' (piezoelectric element) that generates a pressure to discharge a droplet. A piezoelectric element is an example of the pressure generating elements 500 and 500'. The FPC 400 and the FPC 400' are flexible wiring boards (wirings) to transmit a drive signal to the pressure generating element 500 and 500' (piezoelectric element).

In FIG. 4, if identical heat sink 200 is attached to the IC 300 and the IC 300' from the front side of FIG. 4, a surface of the IC 300 is directly attached to the heat sink 200. Conversely, the IC 300' is attached to the heat sink 200 via the FPC 400'. Thus, efficiency of heat dissipation of the IC 300' becomes lower than efficiency of the heat dissipation of the IC 300. Thus, a difference in the temperature is occurred between the IC 300 and the IC 300'. If a difference in temperature occurs between the IC 300 and the IC 300', differences of characteristics of switching elements occurs between the IC 300 and the IC 300'. The characteristics of the switching elements in the IC 300 and the IC 300' includes ON-resistance of an analog switch, for example. Thus, a difference in the discharge characteristics of the inkjet head 1000 occurs that deteriorates print quality.

Embodiment 1

The heat sink 200 in the inkjet head 1000 according to Embodiment 1 includes a portion on the IC 300 side that is directly attached to a surface of the IC 300. The portion on the IC 300 side has a thermal resistance larger than a thermal resistance of a portion on the IC 300' side. Thus, the difference in temperature between the IC 300 and the IC 300' is reduced to substantially zero in the inkjet head 1000 according to Embodiment 1.

That is, the temperatures of the IC 300 and the IC 300' become substantially the same. Increase in the thermal resistance of the portion on the IC 300 side decrease a heat capacity of the portion on the IC 300 side. The same applies to the following description. For example, the portion on the IC 300 side may be made of material having a thermal resistance larger than a thermal resistance of the portion on the IC 300' side of the heat sink 200. Thus, the heat sink 200 includes the portion on the IC 300 side that is directly attached to the surface of the IC 300 and the portion on the IC 300' side that is attached to the surface of the IC 300' via the FPC 400'. The portion on the IC 300 side has a thermal resistance larger than a thermal resistance of the portion on the IC 300' side.

Thus, the inkjet head 1000 of Embodiment 1 can reduce the difference in temperature between the IC 300 and the IC 300' to substantially zero, for example, regardless of structure of the heat sink 200. Thus, the inkjet head 1000 of Embodiment 1 can prevent deterioration of the print quality.

Embodiment 2

Figure 5:
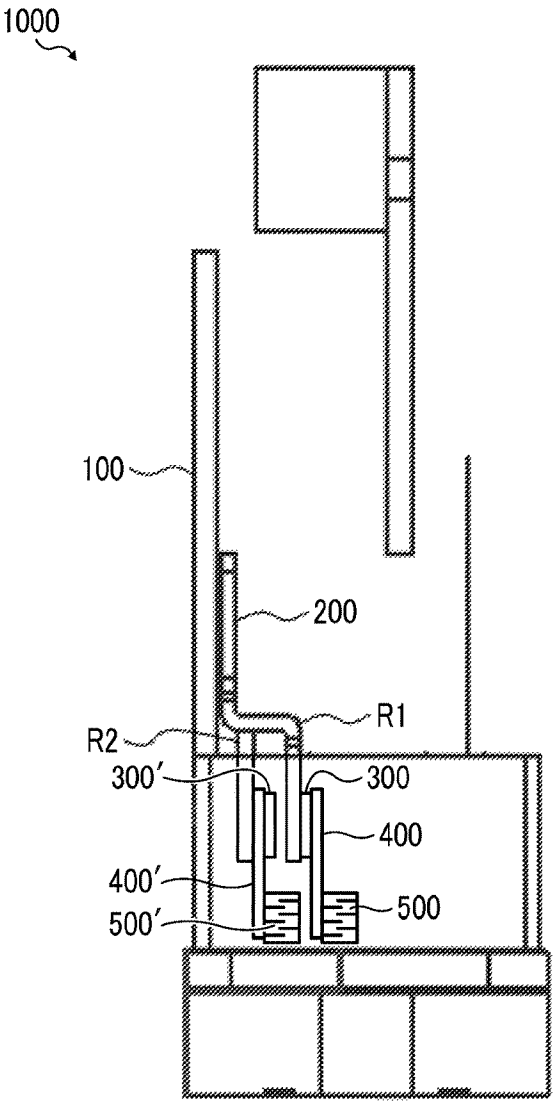
FIG. 5 is a side view of the heat sink in FIGS. 2 and 3.

FIG. 5 illustrates another configuration of the heat sink 200 according to Embodiment 2 of the present disclosure. Specifically, FIG. 5 is a side view of heat sinks 100 and 200 illustrated in FIGS. 2 and 3. As illustrated in FIG. 5, the heat sink 200 includes a path R1 from the portion on the IC 300 side to the heat sink 100 and a path R2 from the portion on the IC 300' side to the heat sink 100. The path R1 is longer than the path R2.

Thus, an efficiency of a heat dissipation of the path R1 is made lower than an efficiency of a heat dissipation of the path R2 to increase the temperature of the IC 300. A length of the path R1 that connects the heat sink 100 and the portion on the IC 300' side of the heat sink 200 is longer than a length of the path R1 that connects the heat sink 100 and the portion on the IC 300 side of the heat sink 200. Here, the length of the path R1 is also referred to as the "length of first dissipation part", and the length of the path R2 is also referred to as the "length of second dissipation part".

Thus, a distance between the IC 300 attached to the FPC 400 and the heat sink 100 is made longer than a distance between the IC 300' attached to the FPC 400' and the heat sink 100. The efficiency of a heat dissipation of the IC 300 becomes lower than the efficiency of a heat dissipation of the IC 300'. Thus, the inkjet head 1000 of Embodiment 2 can reduce the difference in temperature between the IC 300 and the IC 300' to substantially zero, for example. That is, the temperatures of the IC 300 and the IC 300' become substantially the same. Thus, the inkjet head 1000 of Embodiment 1 can prevent deterioration of the print quality.

Embodiment 3

Figure 6:
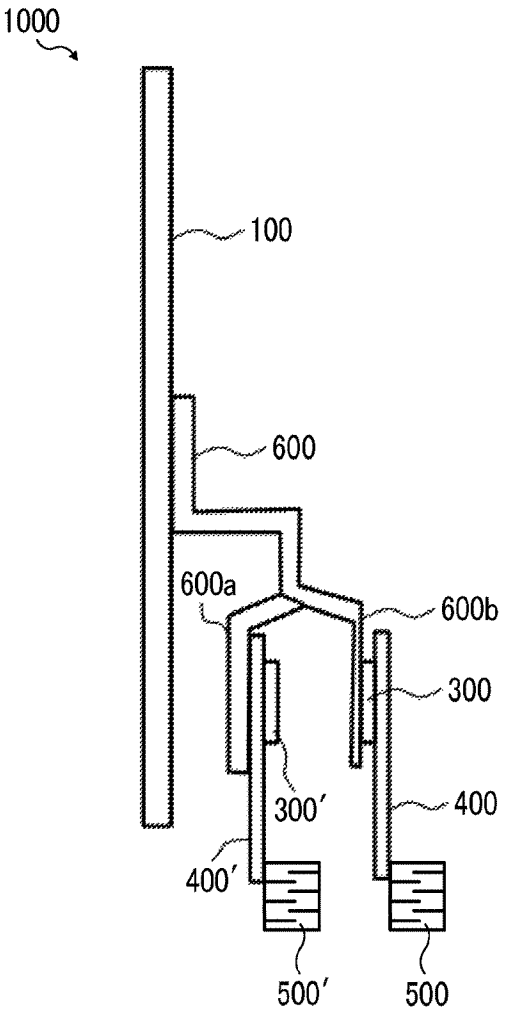
FIG. 6 is a schematic side view of a heat sink according to Embodiment 3.

Next, still another configuration of a heat sink 600 is described below with reference to FIG. 6 as Embodiment 3. FIG. 6 is a schematic side view of heat sink 600 according to Embodiment 3 of the present disclosure. The heat sink 600 in FIG. 6 corresponds to the heat sinks 200 in Embodiments 1 and 2.

As illustrated in FIG. 6, the heat sink 600 includes a portion 600*a* on the IC 300 side that is directly attached to a surface of the IC 300 and a portion 600*b* on the IC 300' side that is attached to the IC 300' via the FPC 400. A thickness of the portion 600*a* on the IC 300 side is made thinner than a thickness of the portion 600*b* on the IC 300'. Decrease in a cross-sectional area of a path (portion 600*a*) through which heat is transmitted increases a thermal resistance of the portion 600*a* on the IC 300 side. Thus, the heat sink 600 includes the portion 600*a* on the IC 300 side (first dissipation part) having a thickness thinner than a thickness of the portion 600*b* on the IC 300' side (second dissipation part).

Thus, the efficiency of a heat dissipation of the IC 300 becomes lower than the efficiency of a heat dissipation of the IC 300'. Thus, the inkjet head 1000 of Embodiment 3 can reduce the difference in temperature between the IC 300 and the IC 300' to substantially zero, for example. That is, the temperatures of the IC 300 and the IC 300' become substantially the same. Thus, the inkjet head 1000 of Embodiment 1 can prevent deterioration of the print quality.

Embodiment 4

Figure 7:
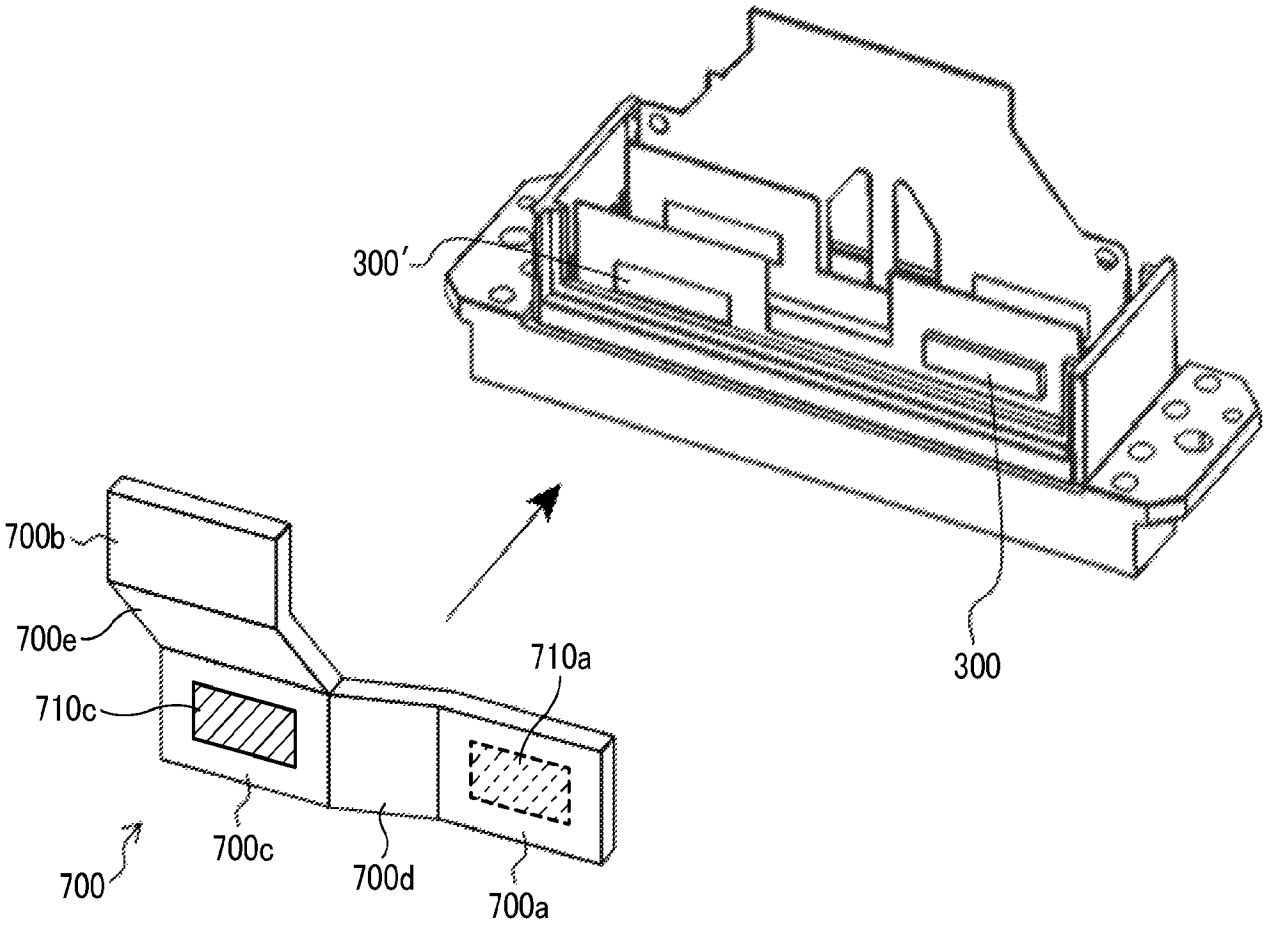
FIG. 7 is a schematic perspective view of a heat sink according to Embodiment 4.

Still another configuration of a heat sink 700 is described below as Embodiment 4. FIG. 7 is a schematic side view of a heat sink 700 according to Embodiment 4 of the present disclosure. The heat sink 700 in FIG. 7 corresponds to the heat sinks 200 in Embodiments 1 and 2.

As illustrated in FIG. 7, the heat sink 700 includes an attaching portion 700*a* on the IC 300 side that is directly attached to a surface of the IC 300, an attaching portion 700*b* that is attached to the heat sink 100 contacting the outside air, and an attaching portion 700*c* on the IC 300' side that is attached to the IC 300' via the FPC 400. The attaching portion 700*c* is disposed between the attaching portion 700*a* and the attaching portion 700*b* to connect the attaching portion 700*a* and the attaching portion 700*b*. Further, the heat sink 700 includes a member 700*d* that connects the attaching portion 700*a* and the attaching portion 700*c* and a member 700*e* that connects the attaching portion 700*c* and the attaching portion 700*b*.

Thus, the heat sink 700 is formed to have a substantially "L-shape" when the heat sink 700 is viewed from an attaching direction indicated by arrow in FIG. 7. Thus, the heat sink 700 includes the attaching portion 700*c* (second dissipation part) attached to the IC 300' side disposed between the attaching portion 700*a* (first dissipation part) attached to the IC 300 and the attaching portion 700*b* attached to the heat sink 100 contacting the outside air.

The heat sink 700 with such a configuration can increase an apparent thermal resistance to increase the temperature of the IC 300 since a heating element is provided on the way of a heat dissipation path to the outside air when the heat sink 700 is viewed from the IC 300 side. Thus, the inkjet head 1000 of Embodiment 2 can reduce the difference in temperature between the IC 300 and the IC 300' to substantially zero, for example. That is, the temperatures of the IC 300 and the IC 300' become substantially the same. Thus, the inkjet head 1000 of Embodiment 1 can prevent deterioration of the print quality.

Embodiment 5

To attach a heating element to a heat sink, an adhesive or a double-sided tape with high thermal conductivity is used between a heat sink and a heating element, or a sheet with high thermal conductivity is sandwiched between a heat sink and a heating element to improve an efficiency of heat dissipation of a heat sink. A heat sink of Embodiment 5 includes a sandwiching member (the adhesive, the double-sided tape, and the sheet as described above) including a first sandwiching member 710*a* at which the heat sink 200, 600, or 700 is directly attached to a surface of the IC 300 and a second sandwiching member 710*c* at which the heat sink 200, 600 or 700 is attached to a surface of the IC 300' via an FPC.

A thermal resistance of the first sandwiching member is larger than a thermal resistance of the second sandwiching member. Thus, the heat sink of Embodiment 5 includes the first sandwiching member that is sandwiched between the first dissipation parts of the heat sinks 200, 600, and 700 and the IC 300, and the second sandwiching member that is sandwiched between the second dissipation part of the heat sinks 200, 600, and 700 and the IC 300'. The thermal resistance of the first sandwiching member is made larger than the thermal resistance of the second sandwiching member.

Thus, the inkjet head 1000 of Embodiment 5 can reduce the difference in temperature between the IC 300 and the IC 300' to substantially zero, for example. That is, the temperatures of the IC 300 and the IC 300' becomes substantially the same. Thus, the inkjet head 1000 of Embodiment 1 can prevent deterioration of the print quality.

As described above, the inkjet heads 1000 (liquid discharge heads) in Embodiments 1 to 5 can reduce a difference in an efficiency of heat dissipation of the heat sink to prevent deterioration in the print quality. The inkjet head 1000 includes a pressure generating elements 500 and 500' that generate a pressure to discharge liquid (ink) droplets, at least two wirings (FPC 400 and FPC 400', for example) that transmit a drive signal to the pressure generating elements 500 and 500', and a plurality of ICs (IC 300 and IC 300', for example) to control to drive the pressure generating elements 500 and 500'.

The IC 300 and IC 300' are provided on the FPC 400 and the FPC 400', respectively. The inkjet head 1000 further includes the heat sink 200 that contact IC 300 and IC 300' to dissipate the heat in the IC 300 and IC 300'. The heat sink 200 includes a first dissipation part (portions 600*b* and 700*a*, etc.) that directly contacts a front surface of the IC 300 and a second dissipating part (portions 600*a* and 700*c*, etc.) that contacts a back surface of the IC 300' via the wiring (FPC 400', etc.).

A thermal resistance of the first dissipation part is made larger than a thermal resistance of the second dissipation part. Thus, the inkjet head 1000 can reduce the efficiency of heat dissipation (cooling) of the portion of the heat sink 200 that is directly attached to the IC 300. Thus, temperature of the IC 300 approaches the temperature of the IC 300' that is attached to the heat sink 200 via the FPC 400' from the back surface of the IC 300'. Thus, the inkjet head 1000 can reduce a difference in the efficiency of heat dissipation (cooling) between the portion of the heat sink 200 that is directly attached to the IC 300 and the portion of the heat sink 200 that is attached to the back surface of the IC 300' via the FPC 400'.

Embodiment 6

Figure 12:
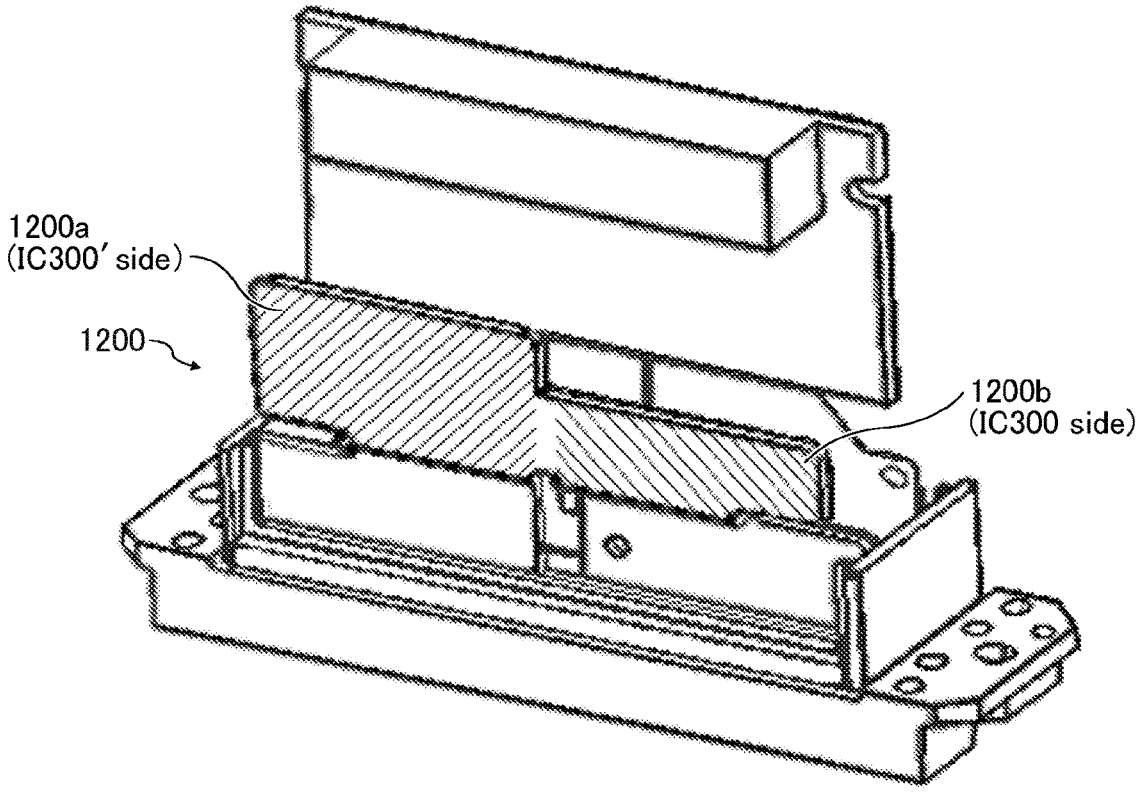
FIG. 12 is a schematic perspective view of a heat sink according to Embodiment 6.

In the inkjet head 1000 of Embodiment 6, a thermal resistance of the heat sink 200 on the IC 300' side is decreased to reduce the difference in temperature between the IC 300 and the IC 300'. The heat sink 200 on the IC 300' side is attached to a back surface of the IC 300' via the FPC 400'. Decrease in a thermal capacity increases a heat capacity as described above. The same applies to the following description. FIG. 12 is a schematic perspective view of a heat sink 1200 in Embodiment 6.

The heat sink 1200 in FIG. 12 corresponds to the heat sinks 200 in Embodiments 1 and 2.

As illustrated in FIG. 12, the heat sink 1200 includes a portion 1200*a* (second dissipation part) that contacts a heat sink 100 on the IC 300' side and a portion 1200*b* (first dissipation part) that contacts the heat sink 100 on the IC 300' side. An area of the portion 1200*a* (second dissipation part) is made larger than an area of the portion 1200*b* (first dissipation part). Thus, the efficiency of the heat dissipation of the IC 300' is increased to decrease the temperature of the IC 300'.

Thus, the heat sink 1200 includes the portion 1200*b* (first dissipation part) on the IC 300 side that is directly attached to the surface of the IC 300 and the portion 1200*a* (second dissipation part) on the IC 300' side that is attached to the surface of the IC 300' via the FPC 400'. The thermal resistance of the portion 1200*a* (second dissipation part) is made smaller than the thermal resistance of the portion 1200*b* (first dissipation part).

Thus, the inkjet head 1000 of Embodiment 5 can reduce the difference in temperature between the IC 300 and the IC 300' to substantially zero, for example. That is, the temperatures of the IC 300 and the IC 300' becomes substantially the same. Thus, the inkjet head 1000 of Embodiment 1 can prevent deterioration of the print quality.

Embodiment 7

Figure 13:
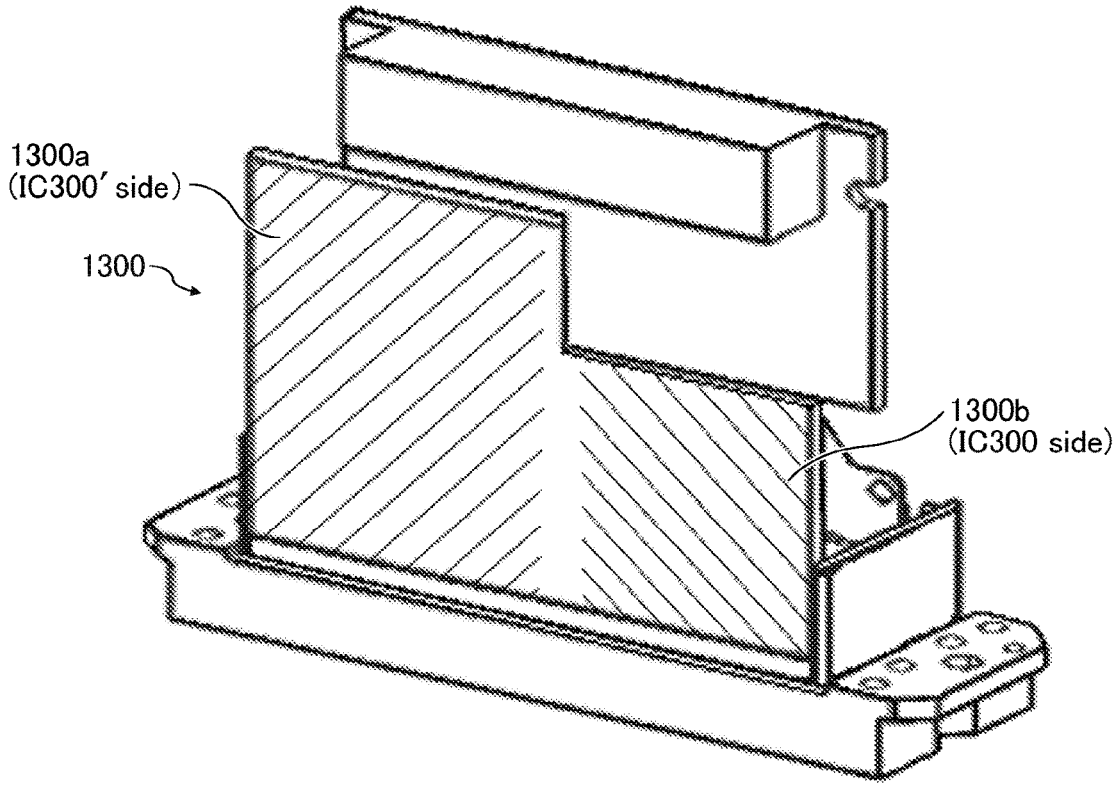
FIG. 13 is a schematic perspective view of a heat sink according to Embodiment 7.

FIG. 13 illustrates configuration of a heat sink 1300 according to Embodiment 7 of the present disclosure. FIG.

13 is a schematic perspective view of the heat sink 1300 in Embodiment 7. The heat sink 1300 in FIG. 13 corresponds to the heat sinks 100 in Embodiments 1 and 2.

As illustrated in FIG. 13, an area of a portion 1300*a* on the IC 300' side is made larger than an area of a portion 1300*b* on the IC 300 side in the heat sink 1300. The portion 1300*a* is the second dissipation part, and the portion 1300*b* is the first dissipation part. Thus, the efficiency of the heat dissipation of the IC 300' is increased to decrease the temperature of the IC 300'. With the configuration in Embodiment 7 illustrated in FIG. 13, effects similar to those attained by Embodiment 6 can be attained in the configuration according to Embodiment 7.

Embodiment 8

Figure 14:
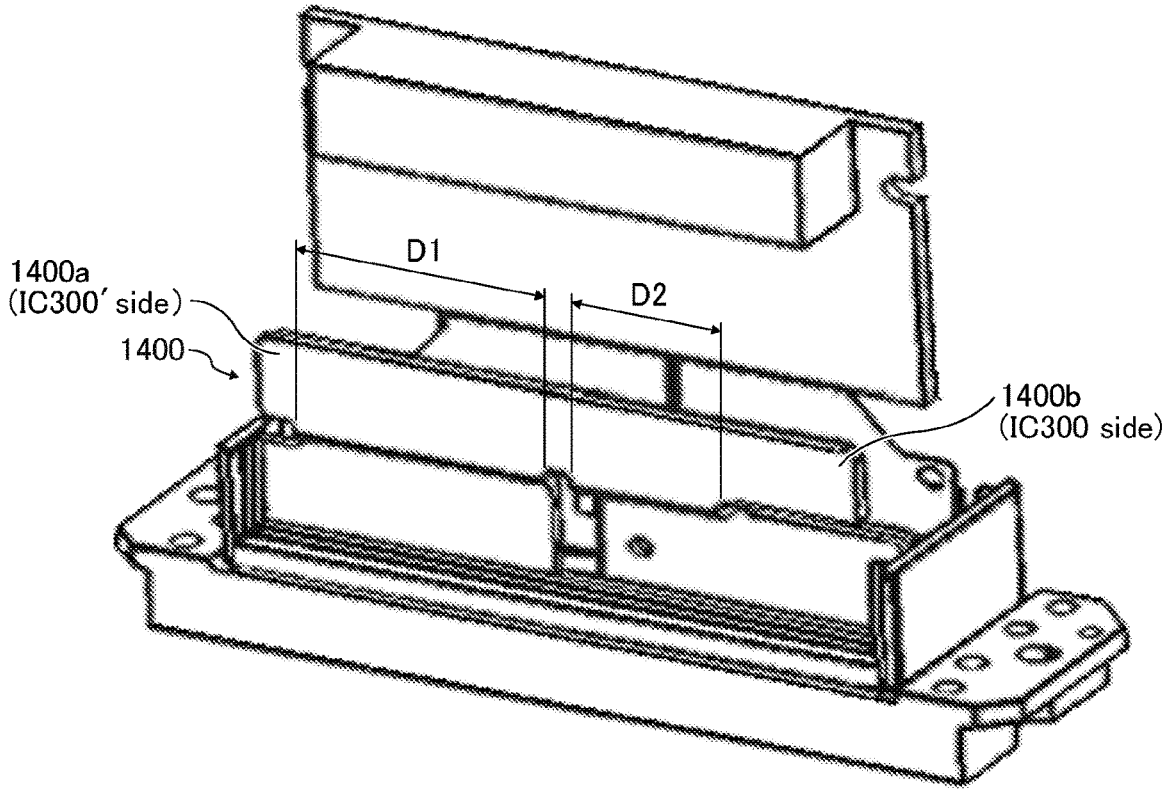
FIG. 14 is a schematic perspective view of a heat sink according to Embodiment 8.

FIG. 14 illustrates another configuration of the heat sink 200 according to Embodiment 8 of the present disclosure. FIG. 14 is a schematic perspective view of the heat sink 1400 in Embodiment 8. The heat sink 1400 in FIG. 14 corresponds to the heat sinks 200 in Embodiments 1 and 2.

As illustrated in FIG. 14, a width D1 of a portion 1400*a* on the IC 300' side is made longer than a width D2 of a portion 1400*b* on the IC 300 side in the heat sink 1400. The portion 1400*a* is the second dissipation part, and the portion 1400*b* is the first dissipation part. The portion 1400*a* is attached to the back surface of the IC 300' via the FPC 400. Thus, a cross-sectional area of a path (portion 1400*a*) through which heat is transferred from the portion 1400*a* to the heat sink 100 is increased. The cross-sectional area of the path (portion 1400*a*) is an area at which the portion 1400*a* contacts the heat sink 100.

Thus, the thermal resistance on the IC 300' side becomes smaller than the thermal resistance on the IC 300 side. The efficiency of a heat dissipation of the IC 300' is increased to be larger than the efficiency of a heat dissipation of the IC 300. Thus, the inkjet head 1000 of Embodiment 8 can reduce the difference in temperature between the IC 300 and the IC 300' to substantially zero, for example. That is, the temperatures of the IC 300 and the IC 300' become substantially the same. Thus, the inkjet head 1000 of Embodiment 8 can prevent deterioration of the print quality.

Embodiment 9

Figure 15:
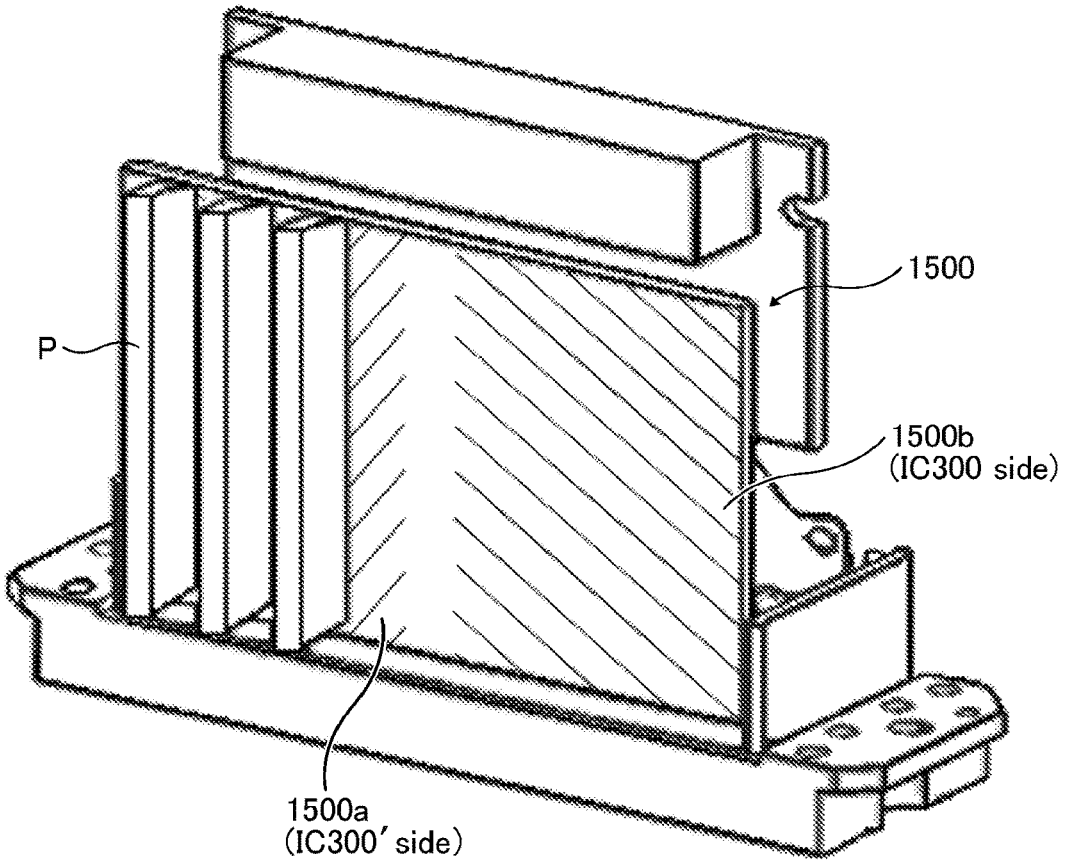
FIG. 15 is a schematic perspective view of a heat sink according to Embodiment 9.
Figure 16:
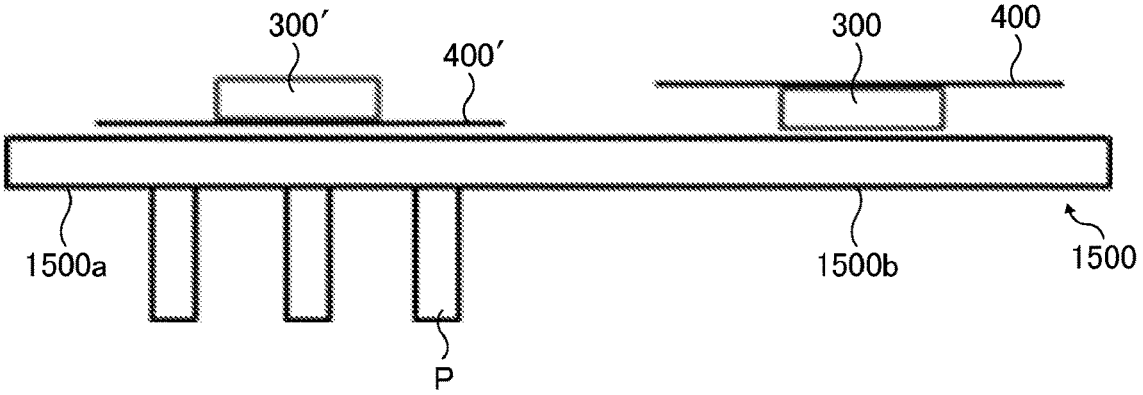
FIG. 16 is a schematic top view of the heat sink according to Embodiment 9.

FIGS. 15 and 16 illustrate configuration of a heat sink 1500 according to Embodiment 9 of the present disclosure. FIG. 15 is a schematic perspective view of the heat sink 1500 in Embodiment 9. FIG. 16 is a schematic top view of the heat sink 1500 in Embodiment 9. The heat sink 1500 in FIGS. 15 and 16 corresponds to the heat sinks 100 in Embodiments 1 and 2.

As illustrated in FIGS. 15 and 16, the heat sink 1500 includes three projections P on a portion 1500*a* on the IC 300' side. More specifically, the projections P are provided on a surface of the portion 1500*a* on the IC 300' side. The portion 1500*a* is disposed outside the inkjet head 1000 to contact outside air. Thus, the portion 1500*a* is connected to the projections P (second dissipation part). Thus, the efficiency of the heat dissipation of the IC 300' is increased to decrease the temperature of the IC 300'.

Conversely, the heat sink 1500 does not include projections P on a portion 1500*b* on the IC 300 side. Thus, the efficiency of the heat dissipation of the IC 300 is smaller than the efficiency of the heat dissipation of the IC 300'.

Thus, the inkjet head 1000 of Embodiment 9 can reduce the difference in temperature between the IC 300 and the IC 300' to substantially zero, for example. That is, the temperatures of the IC 300 and the IC 300' becomes substantially the same. Thus, the inkjet head 1000 of Embodiment 9 can prevent deterioration of the print quality.

As described above, the inkjet heads 1000 (liquid discharge heads) in Embodiments 1 to 9 can reduce a difference in an efficiency of heat dissipation of the heat sink to prevent deterioration in the print quality. Thus, the inkjet head 1000 can reduce the difference in temperature between the IC 300 and the IC 300'. The portion 200*b* on the IC 300 side of the heat sink 200 is directly attached to a front surface of the IC 300.

The portion 200*a* on the IC 300' side of the heat sink 200 is attached to a back surface of the IC 300' via the FPC 400'. Thus, the inkjet head 1000 includes the heat sink 200 having a difference in the thermal resistance (heat capacity) between the portion 200*a* and the portion 200*b* so that the temperature between the IC 300 and the IC 300' becomes substantially the same.

Thus, the difference in efficiency of heat dissipation (cooling) is reduced to substantially zero. Thus, the inkjet head 1000 uniforms the temperature between the IC 300 and the IC 300' to prevent the drive waveform applied to the pressure generating elements 500 and 500' (piezoelectric element) to be different according to the IC 300 because the drive waveform applied to the pressure generating elements 500 and 500' (piezoelectric element) may become different by difference of temperature between the IC 300 and the IC 300'. Thus, the inkjet head 1000 can improve the print quality. Thus, the inkjet head 1000 can reduce a difference in the efficiency of heat dissipation (cooling) of the heat sink 200 between the IC 300 and the IC 300' caused by layout of the FPC 400 and IC 300.

Thus, the inkjet head 1000 can prevent unevenness of discharge characteristics due to temperature difference. When one heat sink 200 is attached to two FPCs 400, one FPC 400 is attached to the heat sink 200 from IC 300 side, and another FPC 400 is attached to the heat sink from a back surface of the heat sink 200 due to layout problems. The configuration of each of the above embodiments are adopted to attain the above-described effects while facilitating attachment of the heat sink 200 to the IC 300 even if a shape of the FPC 400 is unified to reduce cost.

[Liquid Discharge Device]

Figure 9:
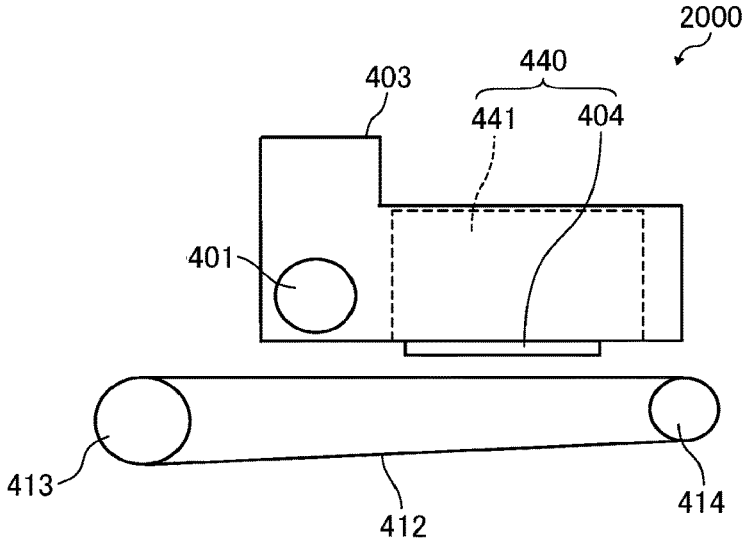
FIG. 9 is a side view of an example of a liquid discharge device.
Figure 10:
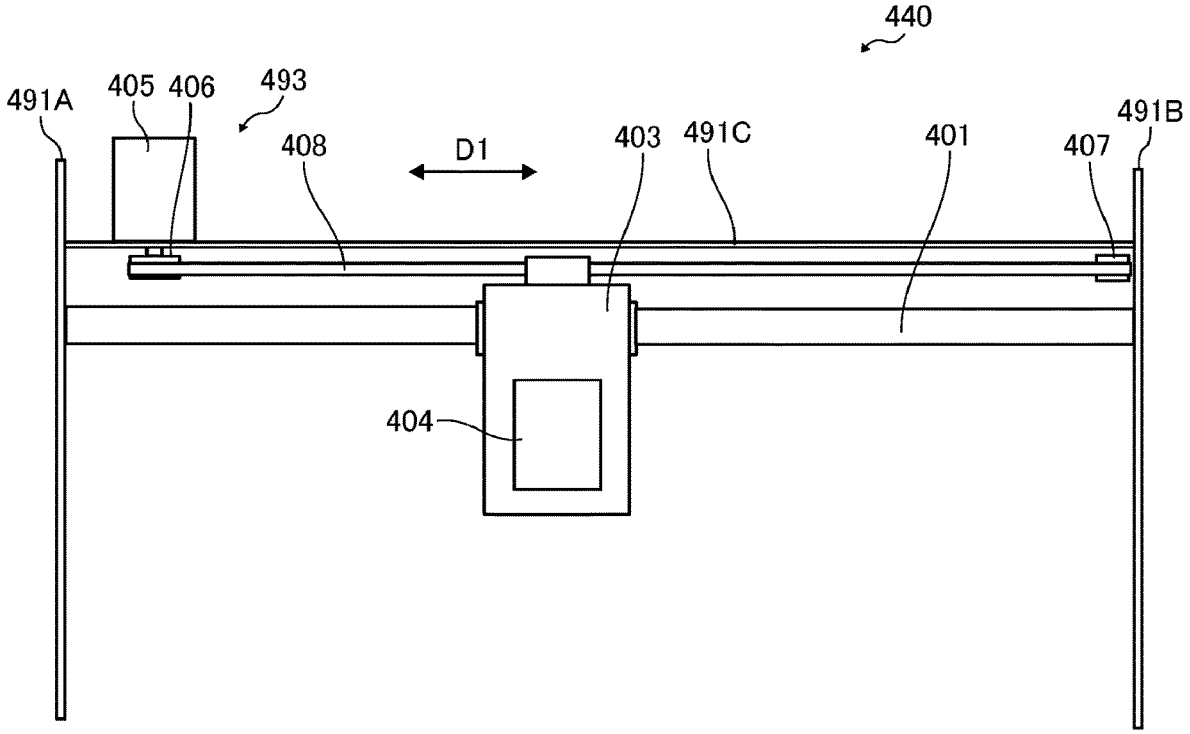
FIG. 10 is a top view of an example of the liquid discharge device.

The liquid discharge device includes a liquid discharge head (inkjet head 1000) as described above. FIGS. 8, 9 and 10 illustrate an example of a liquid discharge device mounted as an inkjet head. Hereinafter, the "inkjet head" is simply referred to as "head".

The term "liquid discharge device" represents a unit in which the head and other functional parts or mechanisms are combined, in other words, an assembly of parts relating to the liquid discharge function. For example, the "liquid discharge device" includes a combination of the head with at least one of a head tank, a carriage, a supply unit, a maintenance unit, and a main scan moving unit to form a single unit.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

FIG. 9 is a side view of an example of liquid discharge apparatus 2000. For example, the liquid discharge apparatus 2000 includes a head 404 and a head tank 441 that form a liquid discharge device 440 as a single unit as illustrated in FIG. 9.

Further, the liquid discharge device 440 is mounted on the carriage 403 in FIG. 9. The carriage 403 is held by a guide 401 constituting a main scan moving unit 493 (see FIG. 10), and reciprocally moves in a main scanning direction indicated by arrow "D1" in FIG. 9.

As illustrated in FIG. 9, the liquid discharge device 440 includes a conveyance belt 412 to convey a recording medium (for example, a sheet) among members constituting a liquid discharge apparatus 2000 as described below. The conveyance belt 412 is an endless belt and is stretched between a conveyance roller 413 and a tension roller 414.

Alternatively, the head 404 and the head tank 441 coupled (connected) with a tube or the like may form the liquid discharge device 440 as a single unit. A unit including a filter can be added at a position between the head tank 441 and the head 404 of the liquid discharge device 440.

In another example, the head 404 and the carriage 403 may form the liquid discharge device 440 as a single unit.

In still another example, the liquid discharge device 440 includes the head 404 movably held by the guide 401 that forms part of a main scan moving unit 493, so that the head 404 and the main scan moving unit 493 form a single unit. As illustrated in FIG. 10, the liquid discharge device 440 may include the head 404, the carriage 403, and the main scan moving unit 493 that form a single unit.

In FIG. 10, the liquid discharge device 440 includes a housing, the main scan moving unit 493, the carriage 403, and the head 404 among components of the liquid discharge apparatus 2000 as described below. The left side plate 491A, the right-side plate 491B, and the rear side plate 491C constitute the housing. The main scanning direction is indicated by arrow "D1" in FIG. 10.

A main scanning motor 405 moves and scans the carriage 403 in the main scanning direction D1 via a timing belt 408 bridged between a driving pulley 406 and a driven pulley 407.

In still another example, a cap that forms part of a maintenance unit may be secured to the carriage 403 mounting the head 404 so that the head 404, the carriage 403, and the maintenance unit form a single unit to form the liquid discharge device 440.

Figure 11:
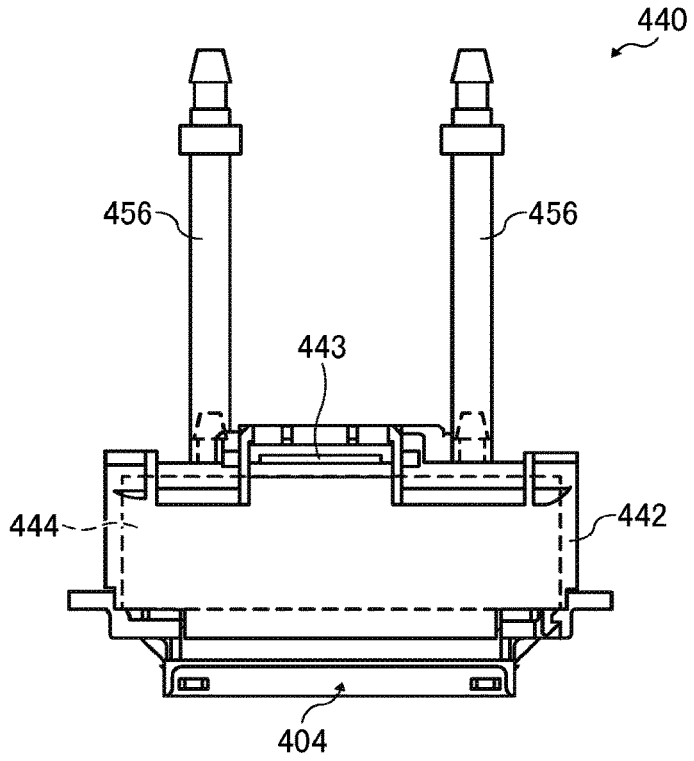
FIG. 11 is a side view of an example of the liquid discharge device.

Further, in still another example, the liquid discharge device 440 includes tubes 456 connected to the head 404 mounting a channel part 444 so that the head 404 and a supply unit form a single unit as illustrated in FIG. 11. The liquid in the liquid storage source is supplied to the head 404 through the tube 456.

Further, the channel part 444 is disposed inside a cover 442. Instead of the channel part 444, the liquid discharge device 440 may include the head tank 441. A connector 443 electrically connected with the head 404 is provided on an upper part of the channel part 444.

The main scan moving unit 493 may be a guide only. The supply unit may be a tube(s) only or a loading unit only.

[Liquid Discharge Apparatus]

The liquid discharge apparatus 2000 includes the above-described head 404 (inkjet head 1000). The liquid discharge apparatus 2000 can achieve both easy assembly and high-efficiency of heat dissipation. Further, the liquid discharge apparatus 2000 includes the head 404 (inkjet head 1000) the maximum discharge amount of which can be increased so that the head 404 can reduce a size of the liquid discharge apparatus 2000 to save a space. Thus, the liquid discharge apparatus 2000 can reduce the size and cost of the liquid discharge apparatus 2000. Thus, the liquid discharge apparatus 2000 can prevent malfunction due to temperature rise and can stably discharge the liquid.

In the present disclosure, the "liquid discharge apparatus" includes the head or the liquid discharge device and drives the head to discharge liquid. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

Further, the term "liquid" includes any liquid having a viscosity or a surface tension that can be discharged from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

Figure 8A:
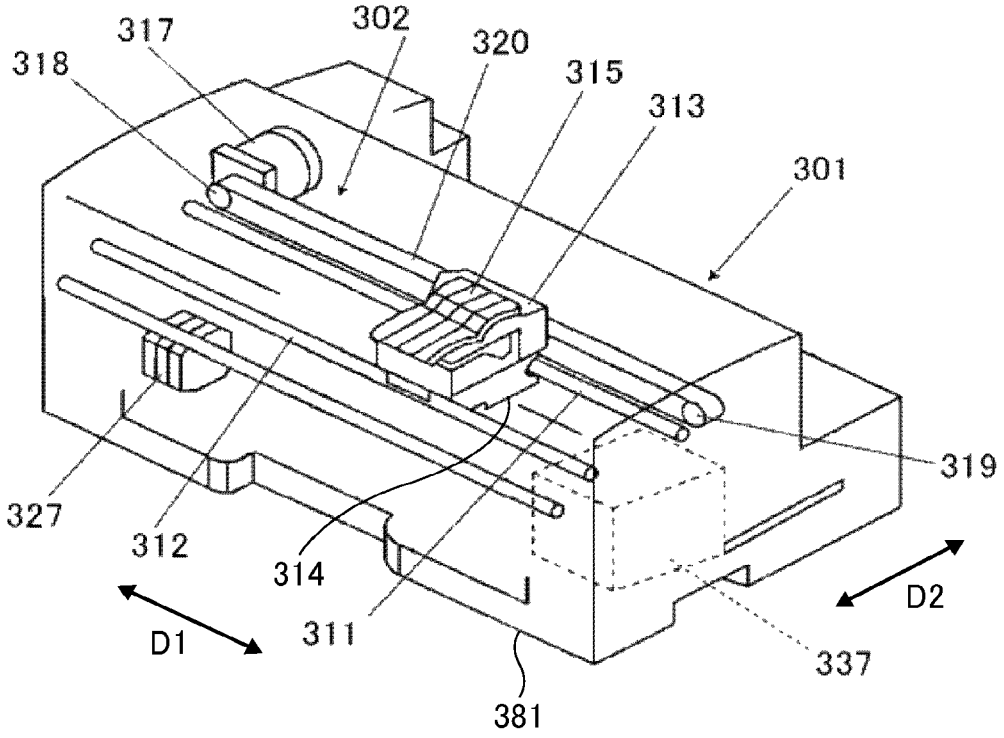
FIG. 8A is a schematic perspective view of the liquid discharge apparatus.
Figure 8B:
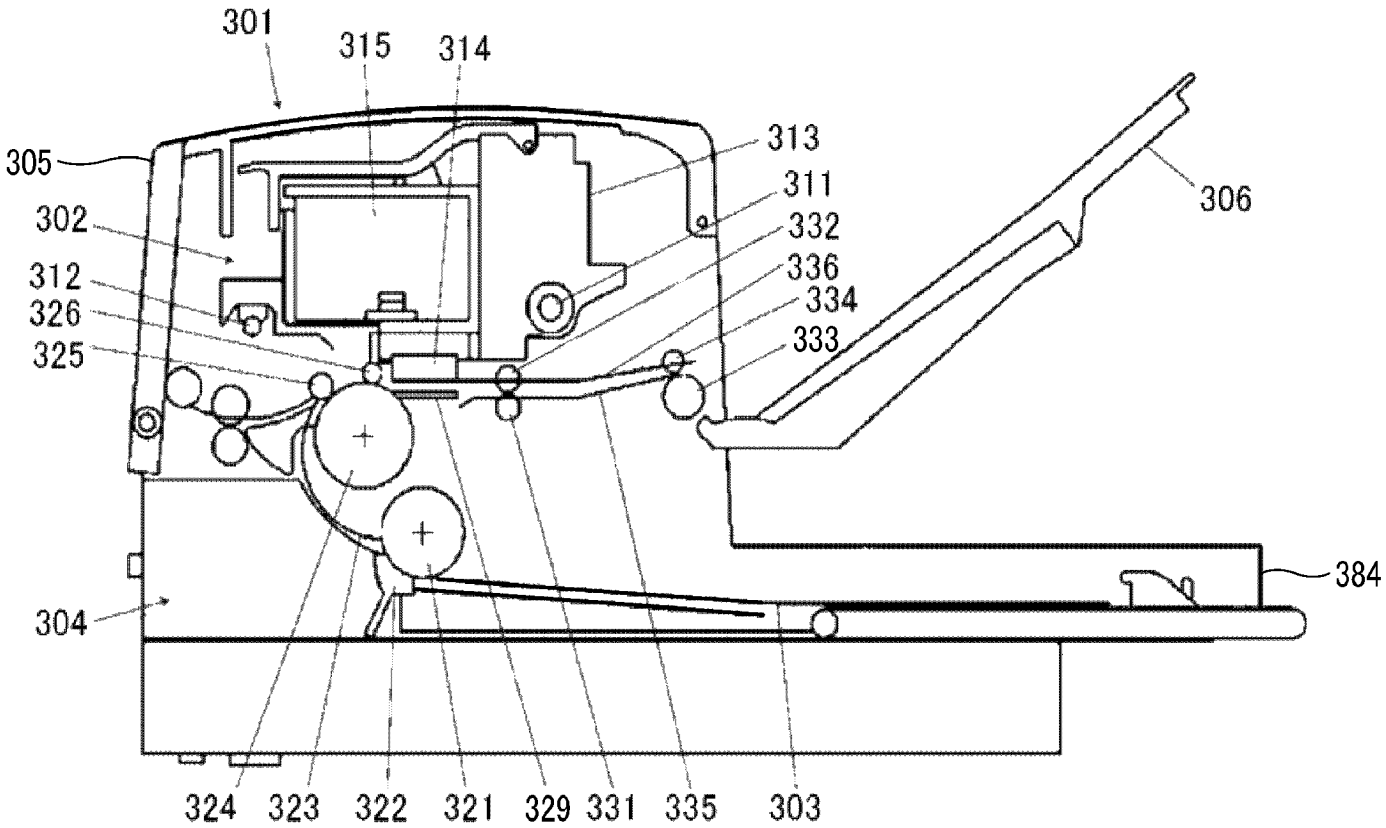
FIG. 8B is a side view of the liquid discharge apparatus.

FIGS. 8A and 8B illustrate an example of an inkjet image forming apparatus 301. The inkjet image forming apparatus 301 is an example of a liquid discharge apparatus 2000 mounting the head 404 as an inkjet head 1000. FIG. 8A is a schematic perspective view of a main part of the inkjet image forming apparatus 301. FIG. 8B is a side view of the inkjet image forming apparatus 301.

The inkjet image forming apparatus 301 includes the liquid discharge device 440 in the printing assembly 302. The liquid discharge device 440 includes a carriage 313 movable in a main scanning direction D1 (see FIG. 10) inside an apparatus body 381, recording heads 314 including the heads 404 (inkjet heads 1000) according to the above-described embodiments mounted on the carriage 313, and ink cartridges 315 to supply ink to the recording heads 314 in an apparatus body 381. The inkjet image forming apparatus 301 further includes a sheet feeding cassette 304 (sheet tray) to stack a large number of recording sheets 303 as recording media.

The sheet feeding cassette 384 is attached to a lower portion of the apparatus body 381 in such a manner that the sheet feeding cassette 304 can be detachably attachable to a front side of the apparatus body 381. Further, the inkjet image forming apparatus 301 includes a manual feed tray 305 to manually feed the recording sheets 303. Further, the recording sheets 303 fed from the sheet feeding cassette 304 or the manual feed tray 305 is taken into the apparatus body 381.

When the recording sheet 303 fed from the sheet feeding cassette 304 or the manual feed tray 305 is conveyed to the printing assembly 302, the printing assembly 302 records a desired image onto the recording sheet 303. The recording sheet 303 is ejected to a sheet ejection tray 306 mounted on a rear side of the apparatus body 381.

The printing assembly 302 holds the carriage 313 with a main guide rod 311 and a sub-guide rod 312 so that the carriage 313 is slidably movable in the main scanning direction D1 (see FIG. 10). The main guide rod 311 and the sub-guide rod 312 are guides laterally bridged between left and right-side plates 491A and 491B (see FIG. 10). The main scanning direction D1 is parallel to a surface of the recording sheet 303. The carriage 313 mounts the recording head 314 that includes four inkjet heads 1000 (heads 404) to discharge droplets of yellow (Y), cyan (C), magenta (M), and black (B) inks, respectively.

Each of the inkjet heads 1000 (heads 404) includes multiple of nozzles arrayed in a nozzle array direction. The recording heads 314 is mounted on the carriage 313 so that the nozzle array direction intersecting the main scanning direction D1. The recording head 314 is mounted on the carriage 313 so that the liquid is discharged downward. Further, the ink cartridges 315 to supply ink of each colors to the recording heads 314 are exchangeably mounted on the carriage 313.

Each of the ink cartridges 315 includes an air communication port communicated with the atmosphere in an upper portion of each ink cartridges 315, an ink supply port in a lower portion of each ink cartridges 315 to supply ink to the recording head 314, and a porous body to be filled with ink inside each ink cartridges 315. The ink supplied to the recording head 314 is maintained at a slight negative pressure by the capillary force of the porous body in the ink cartridges 315.

Although the recording heads 314 of each colors are used in FIGS. 8A and 8B as the recording heads, the recording heads 314 may be a single head having nozzles discharging ink droplets of each colors. Further, the inkjet head 1000 (head 404) used as the recording head 314 may be a piezoelectric-type that applies pressure to the ink through a diaphragm that forms a wall of the liquid chamber with an electromechanical transducer element such as a piezoelectric element (pressure generating element 500), or a bubble-type that generates air bubbles with a heating resistor to pressurize the ink, or an electrostatic-type in which a diaphragm is displaced by the electrostatic force generated between the diaphragm and an electrode facing the diaphragm to pressurize the ink. An inkjet head of an electrostatic type is used in the present disclosure.

A rear side (a downstream side in a sheet conveyance direction) of the carriage 313 is slidably fitted to the main guide rod 311, and a front side (an upstream side in a sheet conveyance direction) of the carriage 313 is slidably mounted to the sub-guide rod 312. The sheet conveyance direction along which the recording sheet 303 is conveyed is indicated by "D2" in FIGS. 8A and 8B. To scan the carriage 313 in the main scanning direction D1, a timing belt 320 is stretched between a driving pulley 318 driven and rotated by a main scanning motor 317 and a driven pulley 319. The timing belt 320 is secured to the carriage 313. The carriage 313 is reciprocally moved (scanned) by forward and reverse rotations of the main scanning motor 317.

The inkjet image forming apparatus 301 further includes a sheet feed roller 321, a friction pad 322, a sheet guide 323, a conveyance rollers 324 and 325, and a leading end roller 326 to convey the recording sheet 303, which is set in the sheet feeding cassette 304, to a portion below the recording heads 314. The sheet feed roller 321 and the friction pad 322 separates and feeds the recording sheets 303 sheet by sheet from the sheet feeding cassette 304.

The sheet guide 323 guides the recording sheets 303. The conveyance roller 324 reverses and conveys the recording sheet 303 fed from the sheet feed roller 321. The conveyance roller 325 is pressed against a circumferential surface of the conveyance roller 324. The leading end roller 326 defines an angle at which the recording sheet 303 is fed from the conveyance rollers 324 and 325. The conveyance roller 324 is rotationally driven by a sub-scanning motor 327 via a gear train.

The inkjet image forming apparatus 301 further includes a print receiver 329 disposed below the recording heads 314. The print receiver 329 is a sheet guide to guide the recording sheet 303, which is fed from the conveyance roller 324, in a range corresponding to a range of movement of the carriage 313 in the main scanning direction D1.

On a downstream side of the print receiver 329 in the sheet conveyance direction D2, the inkjet image forming apparatus 301 includes a conveyance roller 331, a spur roller 332, a sheet ejection roller 333, a spur roller 334, and guides 335 and 336. The conveyance roller 331 is driven to rotate with the spur roller 332 to feed the recording sheet 303 in a sheet ejection direction (sheet conveyance direction D2). The sheet ejection roller 333 and the spur roller 334 further feed the recording sheet 303 to the sheet ejection tray 306. The guides 335 and 336 form a sheet ejection path.

In recording, the inkjet image forming apparatus 301 drives the recording heads 314 according to image signals while moving the carriage 313, to discharge ink onto the recording sheet 303, which is stopped below the recording heads 314, by one line of a desired image. Then, the recording sheet 303 is fed by a predetermined amount and another line is recorded. When a recording end signal or a signal indicating that a rear end of the recording sheet 303 arrives at a recording area is received, a recording operation is terminated and the recording sheet 303 is ejected.

Further, a recovery device 337 to recover a discharge failure of the recording head 314 is disposed at a position out of the recording area on a right side in the moving direction (main scanning direction D1) of the carriage 313. The recovery device 337 includes a cap, a suction unit, and a cleaning unit. In a print standby state, the carriage 313 is moved to a side at which the recovery device 337 is disposed, and the recording heads 314 are capped with the cap. Accordingly, the nozzles (discharge ports) of the recording heads 314 are kept in a wet state, thus preventing discharge failure due to the drying of ink. The inkjet image forming apparatus 301 discharges ink not relating to the recording in the middle of the recording, for example, to maintain the viscosity of ink in all of the nozzles constant, thus maintaining the recording head 314 to stably discharge the liquid (ink).

When a discharge failure has occurred, the nozzles of the recording heads 314 are tightly sealed with the cap, the suction unit sucks ink and bubbles, for example, from the nozzles via tubes, and the cleaning unit removes ink and dust adhered to the surfaces of the nozzles, thus recovering the recording head 314 from the discharge failure. The sucked ink is discharged to a waste ink container disposed on a lower portion of the apparatus body 381 and is absorbed into and held in an ink absorber in the waste ink container.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a plurality of pressure generating elements configured to generate pressure to discharge a liquid;

a plurality of wirings configured to transmit a drive signal to the plurality of pressure generating elements, respectively;

a plurality of integrated circuits including a first integrated circuit configured to drive a first pressure generating element of the plurality of pressure generating elements and a second integrated circuit configured to drive a second pressure generating element of the plurality of pressure generating elements, the plurality of integrated circuits being provided on the plurality of wirings, respectively; and a heat sink configured to contact the plurality of integrated circuits to dissipate heat in the plurality of integrated circuits, wherein the heat sink includes:

a first dissipation part that directly contacts the first integrated circuit; and a second dissipation part that contacts the second integrated circuit via one of the plurality of wirings, and a thermal resistance of the first dissipation part is larger than a thermal resistance of the second dissipation part.

2. The liquid discharge head according to claim 1, wherein a length of the first dissipation part is longer than a length of the second dissipation part.

3. The liquid discharge head according to claim 1, wherein a thickness of the first dissipation part is thinner than a thickness of the second dissipation part.

4. The liquid discharge head according to claim 1, wherein the second dissipation part is disposed between the first dissipation part and a portion of the heat sink that contacts outside air.

5. The liquid discharge head according to claim 4, wherein the second dissipation part connects the first dissipation part and the portion of the heat sink that contacts outside air.

6. The liquid discharge head according to claim 1, wherein the heat sink includes:

a first sandwiching member at which the heat sink is directly attached to a surface of one of the first integrated circuit; and a second sandwiching member at which the heat sink is attached to a surface of the second integrated circuit via the one of the plurality of wirings, and a thermal resistance of the first sandwiching member is larger than a thermal resistance of the second sandwiching member.

7. The liquid discharge head according to claim 1, wherein an area of the second dissipation part is larger than an area of the first dissipation part.

8. The liquid discharge head according to claim 1, wherein the heat sink includes:

the first dissipation part contacting outside air; and the second dissipation part contacting outside air, and an area of the second dissipation part is larger than an area of the first dissipation part.

9. The liquid discharge head according to claim 1, wherein a width of the second dissipation part is longer than a width of the first dissipation part.

10. The liquid discharge head according to claim 1, wherein the heat sink includes a projection on a portion of the second dissipation part of the heat sink, and the portion is disposed outside the liquid discharge head to contact outside air.

11. A liquid discharge apparatus comprising the liquid discharge head according to claim 1.

12. The liquid discharge head of claim 1, wherein the second dissipation part contacts only the second integrated circuit via the one of the plurality of wirings.

13. The liquid discharge head of claim 1, wherein a material of the first dissipation part is different than a material of the second dissipation part.

14. A liquid discharge head, comprising:

a plurality of pressure generating elements configured to generate pressure to discharge a liquid;

a plurality of wirings configured to transmit a drive signal to the plurality of pressure generating elements, respectively;

a plurality of integrated circuits configured to drive the plurality of pressure generating elements, respectively, the plurality of integrated circuits being provided on the plurality of wirings, respectively; and a heat sink configured to contact the plurality of integrated circuits to dissipate heat in the plurality of integrated circuits, wherein the heat sink includes:

a first dissipation part that directly contacts one of the plurality of integrated circuits; and a second dissipation part that contacts another of the plurality of integrated circuits via one of the plurality of wirings, and a thermal resistance of the first dissipation part s larger than a thermal resistance of the second dissipation part.

15. A liquid discharge head, comprising:

a plurality of pressure generating elements configured to generate pressure to discharge a liquid;

a plurality of wirings configured to transmit a drive signal to the plurality of pressure generating elements, respectively;

a plurality of integrated circuits including a first integrated circuit configured to drive a first pressure generating element of the plurality of pressure generating elements and a second integrated circuit configured to drive a second pressure generating element of the plurality of pressure generating elements, the plurality of integrated circuits being provided on the plurality of wirings, respectively; and a heat sink configured to contact the plurality of integrated circuits to dissipate heat in the plurality of integrated circuits, wherein the heat sink includes:

a first dissipation part that directly contacts the first integrated circuit; and a second dissipation part that contacts the second integrated circuit via one of the plurality of wirings, a thermal resistance of the first dissipation part is different from a thermal resistance of the second dissipation part, and wherein a material of the first dissipation part is different than a material of the second dissipation part.

* * * * *